US007290495B2

(12) United States Patent
Tsumiyama

(10) Patent No.: US 7,290,495 B2
(45) Date of Patent: Nov. 6, 2007

(54) PERSONAL WATERCRAFT

(75) Inventor: Yoshinori Tsumiyama, Miki (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/517,173

(22) Filed: Sep. 6, 2006

(65) Prior Publication Data

US 2007/0062429 A1 Mar. 22, 2007

(30) Foreign Application Priority Data

Sep. 7, 2005 (JP) ..... 2005-259056

(51) Int. Cl.
*B63B 35/73* (2006.01)

(52) U.S. Cl. ..... 114/55.53; 114/55.57

(58) Field of Classification Search ..... 114/55.53
See application file for complete search history.

(56) References Cited

U.S. PATENT DOCUMENTS 6,322,409 B1 * 11/2001 Hattori et al. ..... 440/88 R
6,471,557 B1 * 10/2002 Hattori ..... 440/88 R
6,491,557 B2 * 12/2002 Tamaki ..... 440/89 R
2002/0023627 A1 * 2/2002 Nakase et al. ..... 123/516

FOREIGN PATENT DOCUMENTS

JP 2003-200882 7/2003

* cited by examiner

*Primary Examiner*—Ed Swinehart
(74) *Attorney, Agent, or Firm*—Alleman Hall McCoy Russell & Tuttle LLP

(57) ABSTRACT

A personal watercraft including a body including a hull and a deck covering the hull from above; a water jet pump configured to pressurize and accelerate water sucked from a water intake provided on a bottom surface of the hull and eject the water rearward; an engine room that is formed at a front portion of the body and is configured to accommodate an engine; a seat that is mounted over the deck and is located behind the engine room; a steering handle mounted forward of the seat; and a battery accommodating portion that is provided in an interior of the body and is located below the seat and above the water jet pump.

4 Claims, 6 Drawing Sheets

PERSONAL WATERCRAFT

TECHNICAL FIELD

The present invention relates to a personal watercraft, and more particularly to a personal watercraft equipped with a power supply battery placed outside an engine room.

BACKGROUND ART

In recent years, jet-propulsion personal watercraft have been widely used in leisure, sport, rescue activities, and the like. Personal watercraft are equipped with a water jet pump that pressurizes and accelerates water sucked from a water intake generally provided on a hull bottom surface and ejects it rearward from an outlet port. As the resulting reaction, the personal watercraft is propelled forward.

There are stand-up type personal watercraft and straddle-type personal watercraft. The stand-up type personal watercraft includes a concave portion having a flat bottom portion called a standing deck at a rear portion of a deck. Standing on the standing deck, a rider grips a steering handle located forward on the watercraft, to steer the watercraft. An engine room is formed in an interior of a body of the watercraft and is located forward of the standing deck. The straddle-type personal watercraft is equipped with a seat that extends from a substantially middle portion to a rear portion over the deck and is configured to be straddle by the rider. Straddling the seat, the rider grips and steers the steering handle located forward on the watercraft. Typically, the engine room is formed in an interior of the body to be located below the seat. In general, several persons can ride on a straddle-type personal watercraft. As used herein, "forward" is the traveling direction of the watercraft, and "rearward" is the opposite direction.

The above constructed personal watercraft has a battery to start an engine and to supply electric power to indicators such as meters or gauges. In the stand-up type personal watercraft, the battery is accommodated in the interior of the engine room, whereas in straddle-type personal watercraft of a relatively large size, the battery is accommodated in the interior of the engine room, a region rearward of the seat, or the interior of a convex wall portion provided on right and left sides of the deck.

However, the engine room of the personal watercraft has a narrow space. The battery must be positioned not to interfere with the engine, an exhaust pipe, a propeller shaft, etc., and cannot thus be placed flexibly. To charge or maintain the battery, an operator must open an engine hood to take out the battery through an opening above the engine room or must bend the operator's upper body down into the engine room through the opening.

The assignee of the subject application filed a patent application for a personal watercraft that has an engine room formed at a front portion of a body including a hull and a deck and is provided with a battery accommodating space outside the engine room (see e.g., Japanese Laid-Open Patent Application Publication No. 2003-200882).

In recent years, there has been a need for a personal watercraft having features of both the stand-up type personal watercraft and the straddle-type personal watercraft. Such a personal watercraft is intended for one rider's use and is configured to be equipped with a seat behind an engine room and to be steered by a rider in a standing position.

However, it is difficult to design such a personal watercraft so that the battery is accommodated into the engine room where the operator can easily maintain the battery.

Therefore, it becomes necessary to equip the battery at a suitable location outside the engine room.

However, in the straddle-type personal watercraft intended for one rider's use, because of its small size, it is difficult to place the battery into a battery accommodating space outside the engine room as described in the above Japanese Laid-Open Patent Application Publication 2003-200882.

SUMMARY OF THE INVENTION

The present invention addresses the above described conditions, and an object of the present invention is to provide a straddle-type personal watercraft that is equipped with a seat behind an engine room, and is configured to place a battery so that the battery is charged from an outside electric power source and maintained easily.

According to the present invention, there is provided a personal watercraft comprising a body including a hull and a deck covering the hull from above; a water jet pump configured to pressurize and accelerate water sucked from a water intake provided on a bottom surface of the hull and eject the water rearward; an engine room that is formed at a front portion of the body and is configured to accommodate an engine; a seat that is mounted over the deck and is located behind the engine room; a steering handle mounted forward of the seat; and a battery accommodating portion that is provided in an interior of the body and is located below the seat and above the water jet pump. In such a construction, the battery can be placed outside the engine room by utilizing a space formed below the seat and above the water jet pump.

The battery accommodating portion may be disposed on an upper region of a pump casing of the water jet pump. Thereby, the rear portion of the deck can be designed flexibly.

The battery accommodating portion may be provided with a battery mounting bracket which is integral with a front portion of a pump mounting bracket of the water jet pump, and the battery mounting bracket may be fastened to a wall surface of the hull which forms a water passage through which the water sucked from the water intake is drawn to the water jet pump. Thereby, the water jet pump and the battery can be mounted together to the hull with a simple structure. In addition, since the battery can be mounted to the water passage side on an upper region of the water jet pump, it can be easily maintained.

The personal watercraft may further comprise a swelling portion that is formed at a center section in a lateral direction of the deck and is configured to be curved upward, the seat being mounted over a seat mounting surface formed on the swelling portion. The swelling portion may have a rear wall surface that is inclined forward and upward from an aft portion. The battery accommodating portion may be disposed in the vicinity of and below a top portion of the rear wall surface. Since the steering handle is located on a substantially extended line of the rear wall surface that is inclined upward from the aft portion, the rider can easily ride in the watercraft from behind, and the battery can be disposed in a space in the vicinity of and below the top portion of the inclined surface. The inclined rear wall surface is suitably a part of a circular-arc surface that is inclined upward gradually from the aft portion toward the steering handle.

The personal watercraft may further comprise an opening that is formed on the seat mounting surface of the deck and is located just above the battery accommodating portion; and a seal portion that is formed between a lower surface of the seat and the seat mounting surface of the deck and is configured to seal a periphery of the opening. Through the opening formed on the seat mounting surface at the portion just above the battery accommodating portion, the rider can easily access the battery accommodating portion located below the seat, and the seat is able to seal the periphery of the opening.

The personal watercraft may further comprise an engagement member that is attached on a front portion of the swelling portion and is configured to engage with a front portion of the seat; and a fastening member that is attached on a rear portion of the swelling portion and is configured to fasten a rear portion of the seat. The front portion of the seat may be engaged with the engagement member and the rear portion of the seat may be fastened to the fastening member to allow the lower surface of the seat to seal the seal portion. In such a construction, the periphery of the opening can be easily sealed by only engaging the front portion of the seat with the engagement member and by fastening the rear portion of the seat to the fastening member.

The above and further objects and features of the invention will more fully be apparent from the following detailed description with accompanying drawings.

DETAILED DESCRIPTION OF THE PREFERRED EMBODIMENTS

Figure 1:
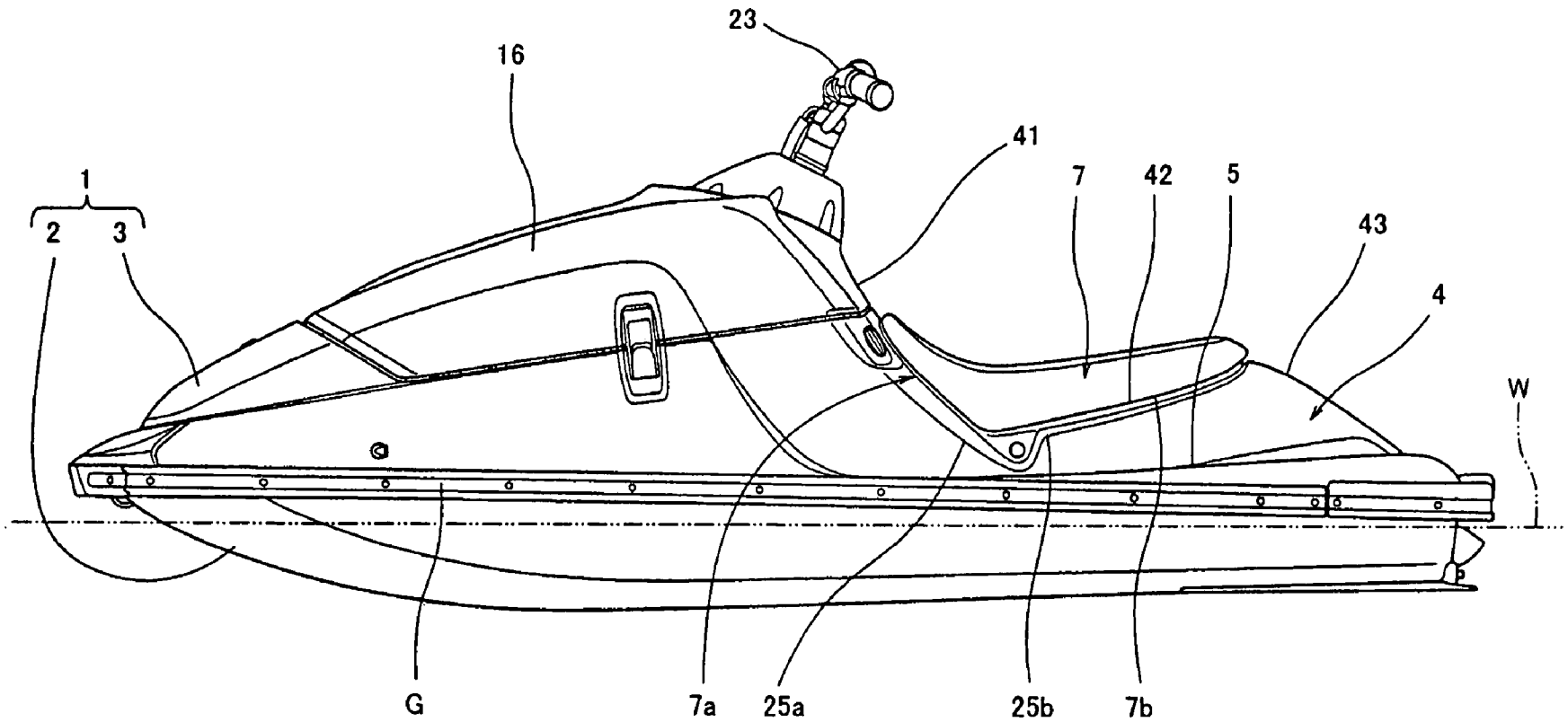
FIG. 1 is a side view of a personal watercraft according to an embodiment of the present invention.
Figure 2:
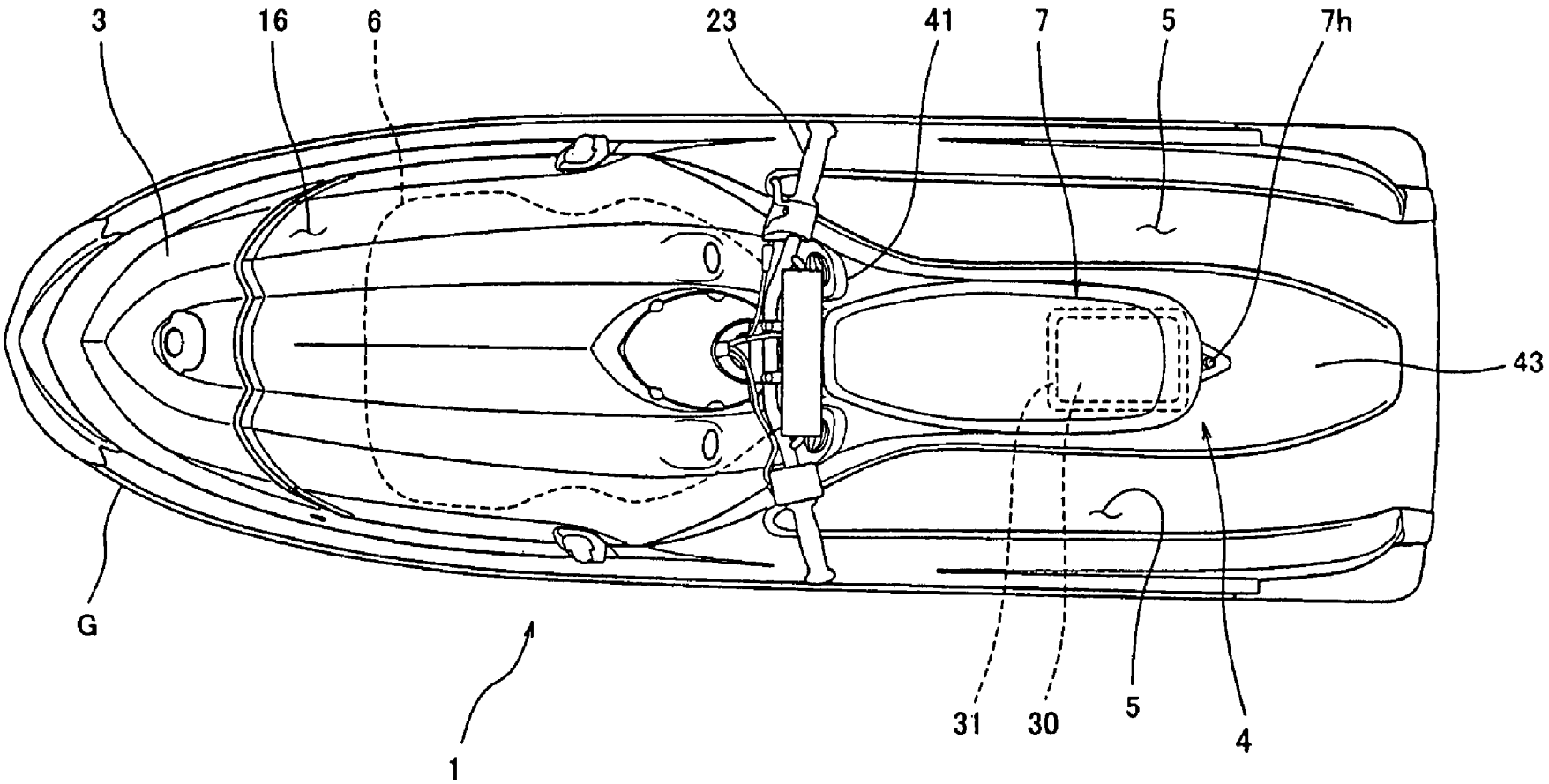
FIG. 2 is a plan view of the personal watercraft of FIG. 1.
Figure 3:
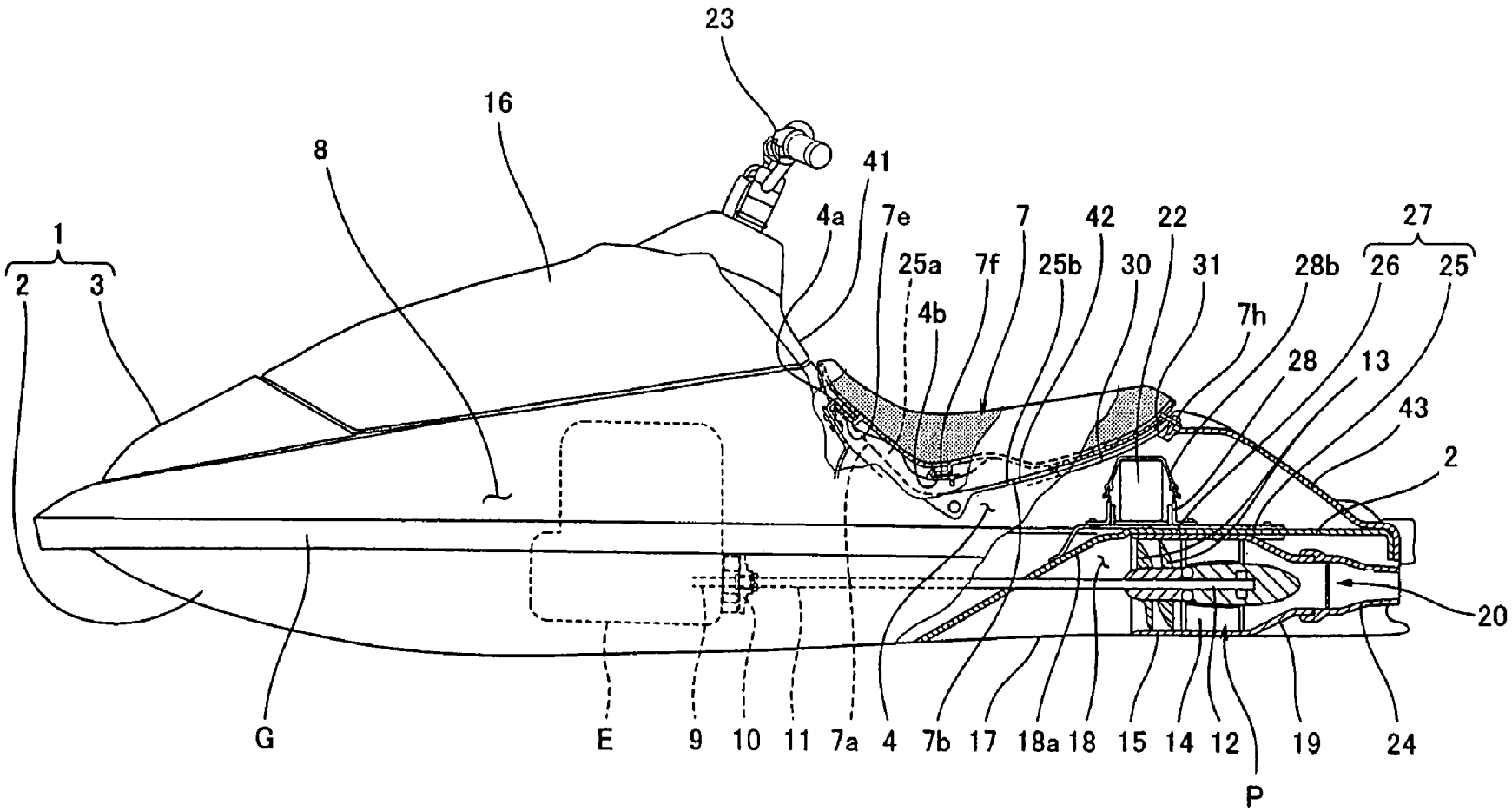
FIG. 3 is a side view of the personal watercraft of FIG. 1, a part of which is cut away.

Hereinafter, an embodiment of a personal watercraft according to the present invention will be described. FIG. 1 is a side view of a personal watercraft according to an embodiment of the present invention. FIG. 2 is a plan view of the personal watercraft of FIG. 1. FIG. 3 is a side view of the personal watercraft of FIG. 1, a part of which is cut away. By way of example, a straddle-type personal watercraft intended for one rider's use will now be described.

Turning to FIGS. 1 and 2, a straddle-type personal watercraft is shown to be equipped with a seat 7 straddled by a rider. A body 1 of the watercraft includes a hull 2 and a deck 3 covering the hull 2 from above. To enable the rider to ride in the watercraft in a straddling position, a swelling portion 4 is formed at a center section in a width direction of a relatively rear portion of the deck 3 to be raised upward. The seat 7 is mounted over an upper surface of the swelling portion 4. A deck floor 5 is formed on right and left sides of the swelling portion 4 to be substantially flat and lower than the swelling portion 4 to enable rider's feet to be put thereon. The deck floor 5 is a standing deck when the rider rides in the watercraft in a standing position. A line at which the hull 2 and the deck 3 are connected over the entire perimeter thereof is called a gunnel line G. As shown in FIG. 1, the gunnel line G is located above a waterline W of the watercraft.

As shown in FIG. 2, a deck opening 6 is formed at a substantially center section of an upper surface of the deck 3 at a front portion of the body 1 (as indicated by a broken line in FIG. 2). A hatch cover 16 is openably mounted over the deck opening 6. Below the deck opening 6, a space defined by the hull 2 and the deck 3 forms an engine room 8 (FIG. 3). The engine room 8 is located forward of a steering handle 23 mentioned later which is mounted forward of the seat 7 and the deck floor 5.

As shown in FIG. 3, the engine E is mounted in the interior of the engine room 8 and is configured to drive the personal watercraft. The configuration of the engine E is not specifically limited. The engine E is mounted such that a crankshaft 9 extends along the longitudinal direction of the body 1. An output end of the crankshaft 9 is coupled to a propeller shaft 11 through a coupling device 10. The propeller shaft 11 is coupled to a pump shaft 12 of the water jet pump P mounted on the rear side of the body 1. The pump shaft 12 is configured to rotate integrally with the cranks 9. An impeller 13 is attached on the pump shaft 12. Fairing vanes 14 are disposed behind the impeller 13. The impeller 13 is covered with a tubular pump casing 15 on the outer periphery thereof.

A water intake 17 is provided on a bottom surface of the hull 2 of the body 1. The water intake 17 is connected to the pump casing 15 through a water passage 18. A pump nozzle 19 is provided on the rear side of the body 1 and is coupled to the pump casing 15. The pump nozzle 19 has a cross-sectional area that is gradually reduced rearward, and an outlet port 20 is provided on the rear end of the pump nozzle 19.

In the above constructed personal watercraft, water is drawn from the water intake 17, through the water passage 18, and to the water jet pump P. The water jet pump P pressurizes and accelerates the water, and the fairing vanes 14 guide water flow behind the impeller 13. The water is ejected rearward through the pump nozzle 19 and from the outlet port 20. As the resulting reaction, the watercraft obtains a propulsion force.

The water jet pump P is fastened to the hull 2 by a pump mounting bracket 25. A battery mounting bracket 26 extends from a front portion of the pump mounting bracket 25 to an upper region of the water passage 18. In this embodiment, the battery mounting bracket 26 is integral with the pump mounting bracket 25 to form a plate-shaped mounting bracket 27. Thereby, components decrease in number and thus compact construction is achieved. In addition, the battery mounting bracket 26 can be fastened stably because of the pump mounting bracket 25 which is stiff.

A front end portion of the battery mounting bracket 26 formed at a front portion of the mounting bracket 27 is fastened to a region of an inclined passage wall surface 18*a* of the hull 2 which forms the water passage 18 connecting the water intake 17 to the pump casing 15. A rear portion of the mounting bracket 27 is fastened to the hull 2 together with the pump casing 15 to form a bridge structure. In a fastened state of the mounting bracket 27, the battery mounting bracket 26 is located at the upper region of the water passage 18. A battery accommodating portion 21 (FIG. 4) in which the battery 22 is accommodated is located at the battery mounting bracket 26. In this manner, the battery accommodating portion 21 is disposed in a space of the body 1 which is located below the seat 7 and above the waterjet pump P.

The steering handle 23 is located forward of the seat 7. The handle 23 is coupled to a steering nozzle 24 behind the pump nozzle 19 through a cable (not shown). When the rider rotates the handle 23 clockwise or counterclockwise, the steering nozzle 24 is pivoted toward the opposite direction so that the ejection direction of the water being ejected through the pump nozzle 19 can be changed, and the watercraft can be correspondingly turned to any desired direction while the water jet pump P is generating the propulsion force.

Turning to FIGS. 1 and 3, when the upper end surface of a region of the swelling portion 4 over which the seat 7 is mounted and the upper surfaces of forward and rearward regions thereof are viewed from the side, a first inclined surface 41 that is inclined rearward and downward at a relatively large angle from a position where the steering handle 23 is attached, a second inclined surface 42 that is inclined rearward and upward at a small angle from a middle position in the longitudinal direction of the seat 7, and a third inclined surface 43 that is inclined rearward and downward at a relatively small angle from a rear end of the seat 7 to an aft portion, are connected to each other. A lower surface of the seat 7 conforms in shape to the first and second inclined surfaces 41 and 42 of the swelling portion 4. As viewed from the side, the lower surface of the seat 7 has at a front portion thereof a first lower surface 7*a* that is inclined forward and upward at a relatively large angle, and at a rear portion thereof a second lower surface 7*b* that is inclined rearward and upward at a relatively small angle.

In this embodiment, the rear portion of the swelling portion 4 is formed by the third inclined surface 43 that is inclined forward and upward at a small angle from the aft portion. The battery accommodating portion 21 is positioned in close proximity to a top portion of the third inclined surface 43 where the front end of the third inclined surface 43 conforms to the rear end of the seat 7. Thus, the watercraft is designed so that the rider can easily ride in the third inclined surface 43 from behind to start the watercraft while ensuring a space for accommodating the battery 22. In addition, to start the watercraft under the situation in which the rider is in the water, the rider hops onto the third inclined surface 43 of the swelling portion 4 from the water and lets the rider's weight rest on the body 1, and under this condition, the rider grips the handle 23 to operate an accelerator, thus starting the watercraft. In this case, because the steering handle 23 is located on an extended line of the third inclined surface 43, the rider easily grips the steering handle 23 with the rider's body part (abdominal part) in contact with the third inclined surface 43 of the swelling portion 4 and positioned on a center line of the body 2, and therefore is able to start the watercraft stably. The provision of the third inclined surface 43 enables the rider to steer the watercraft with the rider's body part on the body 1. As a result, the rider can enjoy a new steering style.

Figure 4:
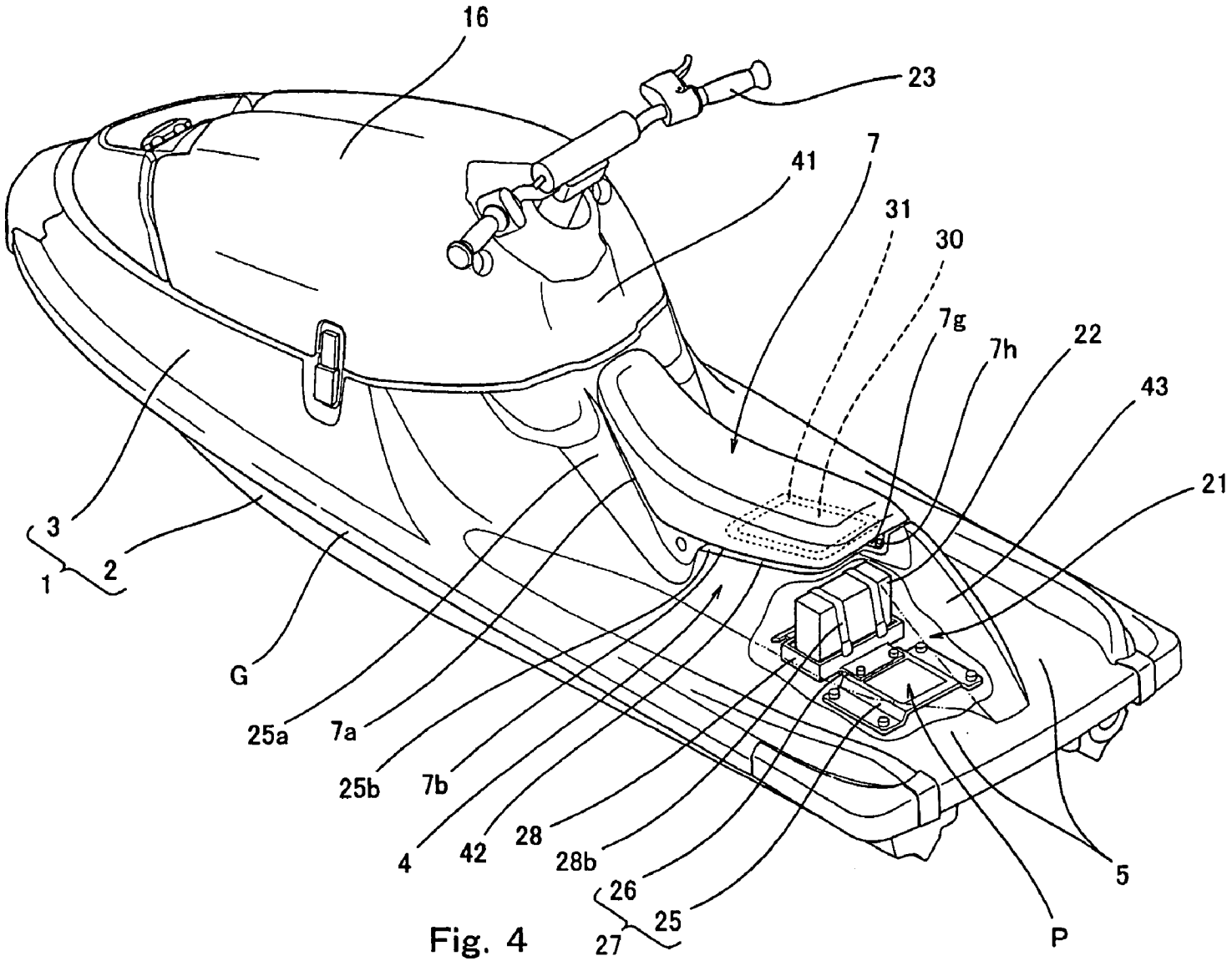
FIG. 4 is a perspective view of the personal watercraft of FIG. 1, illustrating a battery accommodating portion of the watercraft, as viewed from leftward and behind.
Figure 5:
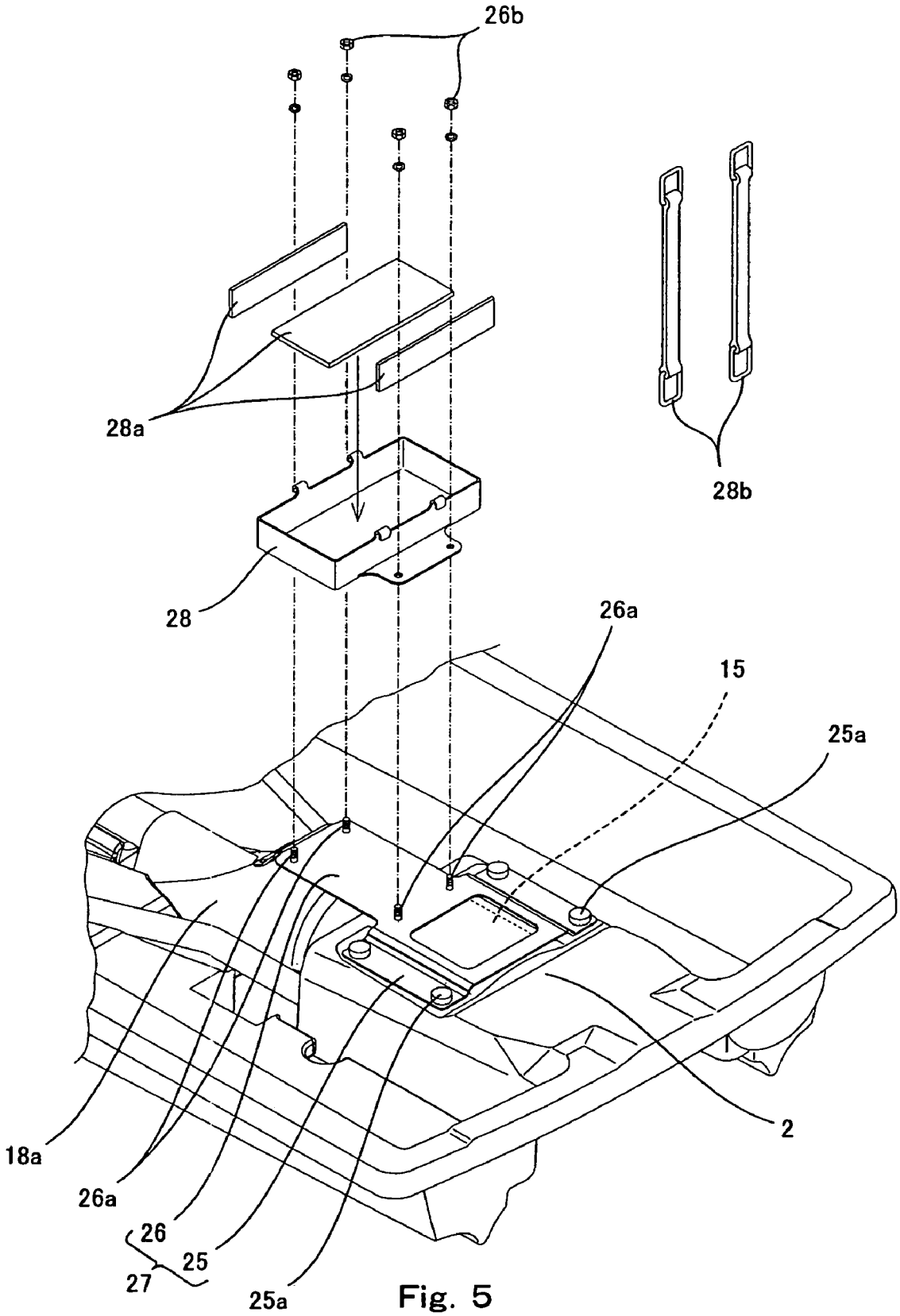
FIG. 5 is an exploded perspective view of the battery accommodating portion of FIG. 4.
Figure 6:
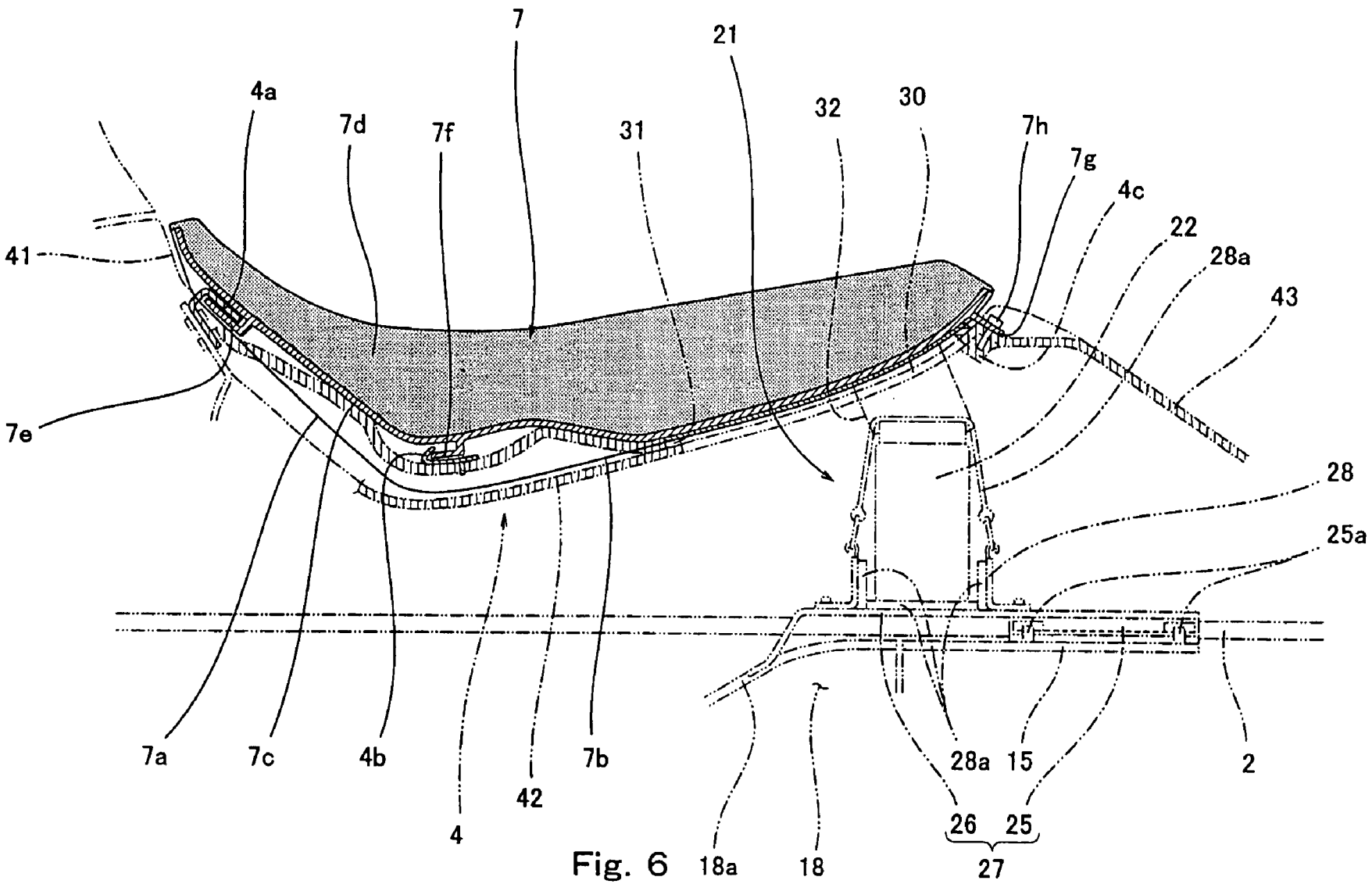
FIG. 6 is a longitudinal sectional view of a seat of the personal watercraft of FIG. 1, as viewed from the side.

FIG. 4 is a perspective view of the personal watercraft of FIG. 1, illustrating the battery accommodating portion 21 of the watercraft, as viewed from leftward and behind. FIG. 5 is an exploded perspective view of the battery accommodating portion 21 of FIG. 4. FIG. 6 is a longitudinal sectional view of the seat 7 of the personal watercraft of FIG. 1, as viewed from the side.

In this embodiment, as shown in FIG. 4, the battery accommodating portion 21 is disposed under the seat 7 mounted over the swelling portion 4 of the deck 3 and above the water jet pump P. In this embodiment, as described above, the third inclined surface 43 is formed at the rear portion of the swelling portion 4 to be inclined upward from the aft portion toward the steering handle 23, and the battery accommodating portion 21 is disposed under the seat 7 and in close proximity to the top portion of the third inclined surface 43. The battery accommodating portion 21 is disposed in a space of the swelling portion 4 having a substantial height and below the seat 7 where the operator can easily maintain the battery 22. Whereas the battery accommodating portion 21 is configured to accommodate the battery 22 in this embodiment, it may alternatively serve as an article container.

In addition, to accommodate the battery 22 into the battery accommodating portion 21 disposed above the water jet pump P, the battery mounting bracket 26 is integral with the front portion of the pump mounting bracket 25 mounted on the pump casing 15 of the waterjet pump P.

As shown in FIG. 5, the rear portion of the mounting bracket 27 is fastened to the hull 2 located on the pump casing 15 of the waterjet pump P (FIG. 3) and the front portion thereof is fastened to the inclined passage wall face 18*a* of the water passage 18 (FIG. 3). To be specific, the pump mounting bracket 25 is provided with mounting bolts 25*a* by which the pump casing 15 is fastened to the hull 2 from above. The pump casing 15 is fastened to the hull 2 by the mounting bolts 25*a* in such a manner that the pump mounting bracket 25 extends over the pump casing 15 in the lateral direction of the body 1. Thereby, the pump casing 15 is fastened to the hull 2 and the mounting bracket 27 is firmly fastened to the hull 2. The battery mounting bracket 26 of the mounting bracket 27 thus fastened is provided with mounting bolts 26*a* protruding upward. The mounting bolts 26*a* serve to fasten a battery fixing member 28 to the battery mounting bracket 26. In this embodiment, two mounting bolts 26*a* are mounted at each of front and rear regions of the battery mounting bracket 26. The battery fixing member 28 is fixed by threadedly engaging nuts 26*b* with the mounting bolts 26*a*

In this embodiment, a cushion member 28*a* is disposed between the battery fixing member 28 and the battery 22. The battery 22 (FIG. 3) is fixed by rubber bands 28*b* engageable with hook portions of the battery fixing member 28 with the cushion member 28*a* disposed between them (FIG. 6).

As shown in FIG. 6, the swelling portion 4 of the deck 3 over which the seat 7 is mounted is provided with a rectangular opening 30 located to correspond to the rear portion of the seat 7. The opening 30 is located substantially just above the battery accommodating portion 21 disposed above the water passage 18 and is configured to expose the battery 22 as viewed from above. By removing the seat 7, the operator can easily access the battery 22 located below the opening 30. Through the opening 30, the battery 22 can be easily maintained, for example, charged from an outside electric power source or taken out.

As shown in FIG. 6, the seat 7 includes a plate-shaped metal frame 7*c* that is attached to the lower surface thereof, and a cushion member 7*d* that is attached to an upper surface of the frame 7*c*. The frame 7*c* has a concave portion which opens downward at a center section in a width direction thereof, and is provided with engagement portions 7*e* and 7*f* on a lower surface of the concave portion at a front region and a center region in a longitudinal direction of the concave portion. The engagement portions 7*e* and 7*f* are hook-shaped and are configured to open forward. A convex portion is formed to protrude upward from a center region in the width direction of the first inclined surface 41 of the swelling portion 41 and a center region in the width direction of the second inclined surface 42 of the swelling portion 41 so as to conform in shape to the concave portion of the seat 7. Engagement members 4*a* and 4*b* (see FIG. 3) are formed on the convex portion. The engagement members 4*a* and 4*b* are hook-shaped to open rearward to be engageable with the engagement portions 7*e* and 7*f*.

A fastening bracket 7*g* is attached to a rear portion of the frame 7*c* and is fastened to a fastening member 4*c* provided at the top portion of the third inclined surface 43 of the swelling portion 4. After the engagement portions 7*e* and 7*f* are engaged with the engagement members 4*a* and 4*b*, the fastening bracket 7*g* is fastened to the fastening member 4*c* by a bolt 7*h*. Thereby, the seat 7 is fastened to the swelling portion 4. In this embodiment, the seat 7 can be removably mounted to the swelling portion 4 by using one bolt.

Furthermore, in this embodiment, a seal portion (FIG. 2) is formed around the opening 30 formed on the upper surface of the swelling portion 4. The seal portion includes a seal member 31 that seals the opening 30 to inhibit entry of water into the opening 30. The seal member 31 is formed of a rubber member, etc., of a rectangular shape to seal the periphery of the rectangular opening 30.

After the seal member 31 is mounted around the opening 30, the seat 7 is fixed so that the lower surface of the seal 7 is in contact with the seal member 31, thereby accomplishing sealing of the periphery of the opening 30. By merely mounting the seat 7, the opening 30 can be sealed. Whereas the lower surface of the seat 7 is directly pressed against the seal member 31 to seal the opening 30 in order to inhibit entry of the water, the seat 7 may alternatively be provided on the lower surface thereof with a bottom plate configured to be pressed against the seal member 31. Furthermore, whereas the seal member 31 is attached around the opening 30, it may alternatively be attached on the lower surface of the seat 7.

By fastening the above constructed seat 7 to the swelling portion 4, the periphery of the opening 30 is sealed to inhibit entry of water, whereas by removing the seat 7, the operator can easily maintain the battery 22 through the opening 30, as can be seen from FIGS. 3 and 6.

In accordance with the personal watercraft constructed above, since the battery 22 is positioned below the seat 7 outside the engine room 8, and in the interior of the deck 1 above the water jet pump P, the engine E, an exhaust pipe, the propeller shaft 11, etc. can be placed flexibly in the interior of the engine room 8, and the watercraft can be designed flexibly. In addition, since the periphery of the opening 30 can be sealed by mounting the seat 7, the operator can easily maintain the battery 22.

Furthermore, by positioning the battery 22 disposed in the interior of the body 1 below the seat 7 and above the water jet pump P, at the substantially center position in the width direction of the body 1, weight is well balanced.

Whereas the rubber bands 28*b* are used to secure the battery 22 as illustrated in FIG. 6, a battery retaining member 32 may alternatively be mounted on a lower portion of the seat 7 as indicated by one dotted line of FIG. 6 and may secure the battery 22 by mounting the seat 7. The battery retaining member 32 may be desirably configured to be elastically pressed against the battery 22 with the seat 7 secured, depending on the size of the battery 22, the shape of the seat 7, etc.

Moreover, the shape of the opening 30 formed on the lower surface of the seat 7 is not limited to a rectangular shape but may be another suitable shape which allows the operator to easily maintain the battery 22.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A personal watercraft comprising:

a body including a hull and a deck covering the hull from above;

a water jet pump configured to pressurize and accelerate water sucked from a water intake provided on a bottom surface of the hull and eject the water rearward;

an engine room that is formed at a front portion of the body and is configured to accommodate an engine;

a seat that is mounted over the deck and is located behind the engine room;

a steering handle mounted forward of the seat; and a battery accommodating portion that is provided in an interior of the body and is located below the seat and above the water jet pump;

wherein the battery accommodating portion is disposed on an upper region of a pump casing of the water jet pump; and wherein the battery accommodating portion is provided with a battery mounting bracket which is integral with a front portion of a pump mounting bracket of the water jet pump, and the battery mounting bracket is fastened to a wall surface of the hull which forms a water passage through which the water sucked from the water intake is drawn to the water jet pump.

2. The personal watercraft according to claim 1, further comprising:

a swelling portion that is formed at a center section in a lateral direction of the deck and is configured to be curved upward, the seat being mounted over a seat mounting surface formed on the swelling portion;

wherein the swelling portion has a rear wall surface that is inclined forward and upward from an aft portion; and wherein the battery accommodating portion is disposed below and in the vicinity of a top portion of the rear wall surface.

3. The personal watercraft according to claim 2, further comprising:

an opening that is formed on the seat mounting surface of the deck and is located just above the battery accommodating portion; and a seal portion that is formed between a lower surface of the seat and the seat mounting surface of the deck and is configured to seal a periphery of the opening.

4. The personal watercraft according to claim 3, further comprising:

an engagement member that is attached on a front portion of the swelling portion and is configured to engage with a front portion of the seat; and a fastening member that is attached on a rear portion of the swelling portion and is configured to fasten a rear portion of the seat;

wherein the front portion of the seat Is engaged with the engagement member and the rear portion of the seat is fastened to the fastening member to allow the lower surface of the seat to seal the seal portion.

* * * * *